United States Patent [19]

Lykens

[11] Patent Number: 4,941,661

[45] Date of Patent: Jul. 17, 1990

[54] ADJUSTABLE BASKETBALL BACKBOARD APPARATUS

[76] Inventor: Gregory S. Lykens, 1409 Kingswood Dr., Fulton, Mo. 65251

[21] Appl. No.: 309,484

[22] Filed: Feb. 13, 1989

[51] Int. Cl.[5] ..... A63B 63/08

[52] U.S. Cl. ..... 273/15 R; 254/98

[58] Field of Search ..... 273/1.5 R A; 254/98–103

[56] References Cited

U.S. PATENT DOCUMENTS

| | | | |
|---|---|---|---|
| 1,853,600 | 4/1932 | Bodendieck | 254/98 |
| 2,586,324 | 6/1971 | Bearson | 273/1.5 R |
| 2,916,288 | 12/1959 | Chervenka | 273/1.5 R |
| 4,183,522 | 1/1980 | Killen | 273/1.5 R |
| 4,395,040 | 7/1983 | White | 273/1.5 R |
| 4,526,367 | 7/1985 | Haston et al. | 273/1.5 R |
| 4,643,422 | 2/1987 | Crablett | 273/1.5 R |
| 4,684,129 | 8/1987 | Andersen et al. | 273/1.5 R |

FOREIGN PATENT DOCUMENTS

| | | | |
|---|---|---|---|
| 2819659 | 11/1979 | Fed. Rep. of Germany | 273/1.5 R |
| 526431 | 5/1955 | Italy | 254/98 |
| 628547 | 11/1961 | Italy | 273/1.5 R |
| 702346 | 1/1954 | United Kingdom | 254/99 |

OTHER PUBLICATIONS

Washington Post, 03/04/1987, p. c7, Tank McNamara.

*Primary Examiner*—Paul E. Shapiro

*Attorney, Agent, or Firm*—Leon Gilden

[57] ABSTRACT

An adjustable basketball backboard apparatus is set forth wherein an elongate slotted support secures a plurality of vertically positionable support arms therefrom which in turn secure a basketball backboard and net. The arms are integrally secured to a support cylinder which surroundingly encompasses a plurality of adjustment nuts threadedly positionable relative to a support rod rotatably mounted to adjust the basketball backboard assembly vertically upon rotation of the support rod.

10 Claims, 1 Drawing Sheet

ADJUSTABLE BASKETBALL BACKBOARD APPARATUS

BACKGROUND OF THE INVENTION

1. Field of the Invention

The field of the invention relates to basketball supports, and more particularly pertains to a new and improved adjustable basketball backboard apparatus wherein the same compactly and efficiently vertically positions a backboard to accomodate players of various age groups and heights, as well as enabling repair of the background and net structure by a lowering of the backboard.

2. Description of the Prior Art

The use of basketball backboards adjustably mounted is well known in the prior art. Heretofore the prior art has utilized cumbersome and complex organizations to adjust a basketball backboard net assembly vertically relative to an underlying support surface. For example, U.S. Pat. No. 4,183,522 to Killen sets forth a bracket structure extending rearwardly of a backboard for interengagement with a plurality of support bases wherein the brackets utilize hooks secured within apertures of the supports for vertical alignment of the apparatus. The Killen patent does not provide a means for the underlying rotatable adjustment feature of the instant invention.

U.S. Pat. No. 4,395,040 to White sets forth an adjustable backboard utilizing a parallelogram organization to adjust the height of the backboard. The White patent utilizes a relatively complex organization of linkages relatively remote from that of the instant invention that provides for a compact organization readily securable to a variety of support columns.

U.S. Pat. No. 4,526,367 to Haston, et al., sets forth an adjustably mounted backboard assembly mounted on wheels and lowered by means of a cable and pulley arrangement requiring an array of inter-related mechanisms of a complexity greatly enhanced and simplified by that of the instant invention to provide a more effective and readily utilized organization.

U.S. Pat. No. 4,643,422 to Cramblett sets forth a vertically mounted backboard for use in a basketball organization wherein a frame is mounted to a mounting organization to provide a rectangular carriage mounting the backboard directly thereto wherein the carriage does not provide the advantage of the instant invention to space the backboard relative to the support organization to minimize potential injury to players by positioning the support organization remote from the backboard.

U.S. Pat. No. 4,684,129 to Andersen sets forth a basketball support standard and orthogonally arranged strut wherein the standard includes an adjustment mechanism to telescopingly reposition the standard for vertical adjustment of the backboard.

As such, it may be appreciated that there is a continuing need for a new and improved adjustable basketball backboard apparatus which addresses both the problems of compactness of organization and effectiveness in use, and in this respect, the present invention substantially fulfills this need.

SUMMARY OF THE INVENTION

In view of the foregoing disadvantages inherent in the known types of basketball backboard apparatus now present in the prior art, the present invention provides an adjustable basketball backboard aparatus wherein the same provides for efficient and compact apparatus to vertically position a backboard assembly relative to a support member which can be easily and efficiently operated during periods of use. As such, the general purpose of the present invention, which will be decribed subsequently in greater detail, is to provide a new and improved adjustable basketball backboard apparatus which has all the advantages of the prior art basketball backboard apparatus and none of the disadvantages.

To attain this, the present invention comprises an adjustable basketball backboard apparatus including a basketball backboard and frame organization integrally secured to a plurality of rearwardly extending support arms extending interiorly of an elongate vertical slotted channel member. The slotted channel member includes a support cylinder integrally securing the rearwardly extending support arms and adjustably mounted to a threaded support rod whereupon rotational support rod vertically repositions the backboard apparatus relative to the support channel.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adjustable basketball backboard apparatus which has all the advantages of the prior art basketball backboard apparatus and none of the disadvantages.

It is another object of the present invention to provide a new and improved adjustable basketball backboard apparatus which may be easily and efficiently manufactured and marketed.

It is a further object of the present invention to provide a new and improved adjustable basketball backboard apparatus which is of a durable and reliable construction.

An even further object of the present invention is to provide a new and improved adjustable basketball backboard apparatus which is susceptible of a low of manufacture with regard to both materials and labor, and which accordingly is then susceptible of low prices of sale to the consuming public, thereby making such adjustable basketball backboard apparatus economically available to the buying public.

Still yet another object of the present invention is to provide a new and improved adjustable basketball backboard apparatus which provides in the apparatuses and methods of the prior art some of the advantages thereof, while simultaneously overcoming some of the disadvantages normally associated therewith.

Still another object of the present invention is to provide a new and improved adjustable basketball backboard apparatus wherein the same provides a rigid, yet adjustable, organization to reposition a basketball backboard assembly remotely relative to a vertical support standard.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2, 3, 4, 5:
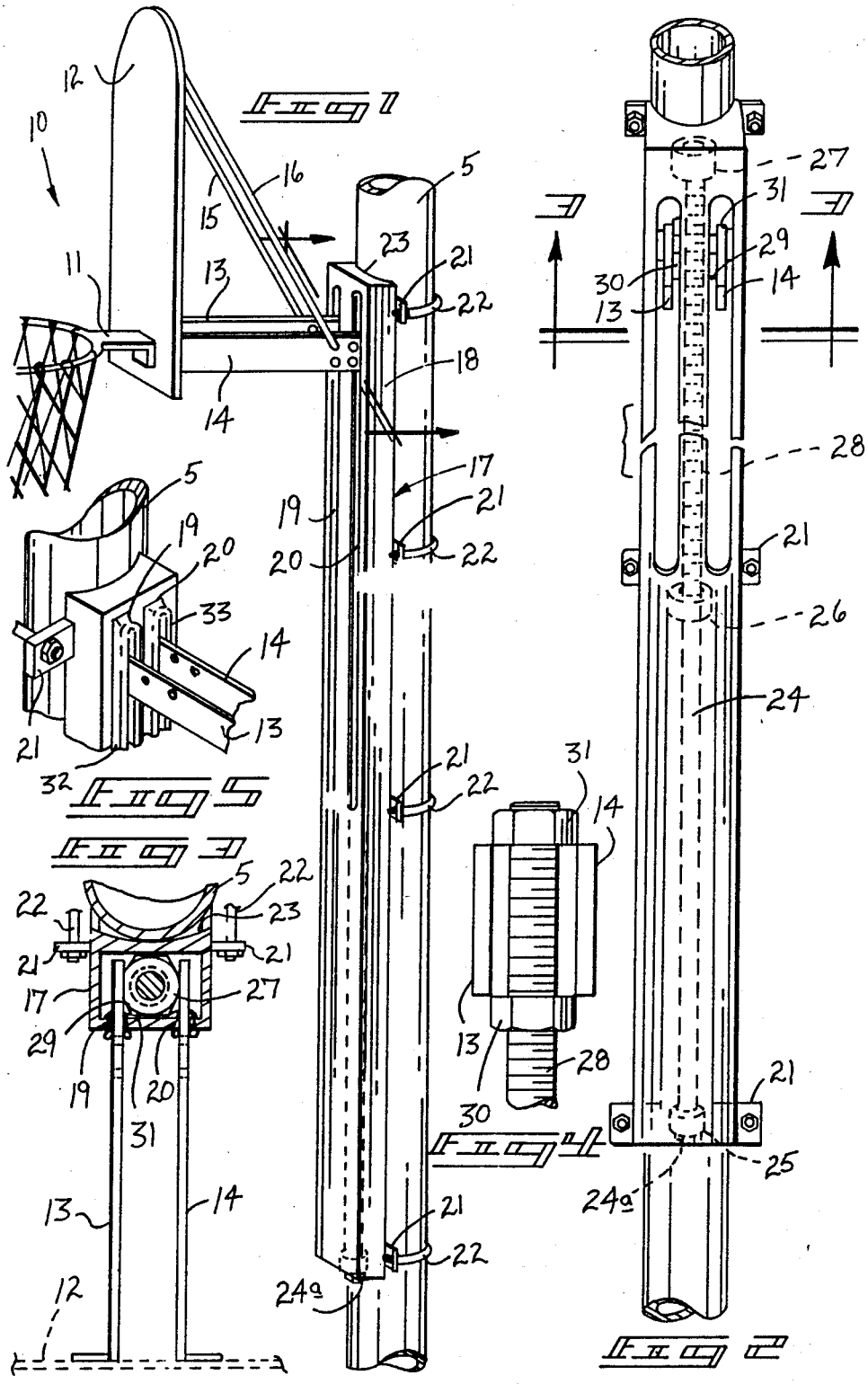
FIG. 1 is an isometric illustration of the instant invention.
FIG. 2 is an orthographic view taken along the lines 2—2 of FIG. 1.
FIG. 3 is an orthographic view taken along the lines 3—3 of FIG. 2 in the direction indicated by the arrows.
FIG. 4 is an orthographic view, somewhat enlarged, of the support cylinder adjustably mounted to the support rod.
FIG. 5 is a isometric illustration including a modified slotted support channel utilizing sealing flaps to prevent contamination of the bearing and adjustment mechanism by the intrusion of airborne contaminants.

With reference now to the drawings, and in particular to FIGS. 1 to 5 thereof, a new and improved adjustable basketball backboard apparatus embodying the principles and concepts of the present invention and generally designated by the reference numeral 10 will be described.

More specifically, it will be noted that the adjustable basketball backboard apparatus 10 essentially comprises an outwardly extending, horizontally oriented backboard frame and net organization 11 orthogonally secured to a rearwardly positioned backboard 12 extending upwardly in a conventional manner abbout the frame and net organization 11. A first and second horizontal support arm 13 and 14 respectively extend orthogonally and rearwardly of the backboard 12 at the forwardmost terminal ends thereof and extend interiorly of an enclosed support channel 17 securable to an upstanding support post or standard "S". A first support strut 15 secures and provides a triangulation of support to the backboard 12 and is secured to the backboard 12 at one end and to the first support arm 13 at its other end. Similarly, a second support strut 16 extends from the backboard 12 to the second support arm 14. The enclosed support channel 17 includes an upper slotted channel portion 18 including a plurality of first and second parallel elongate slots 19 and 20 respectively extending a predetermined distance consistent with the desired adjustment of the backboard frame and net organization 11. Typically, a two to five foot adjustment of the backboard 12 and net assembly is desired and accordingly the slots may be a distance from two to five feet in length and extend coextensively with the upper enclosed slotted channel 18. The support channel 17 itself may preferably utilize an arcuate rear surface to accomodate the cylindrical support standard "S" and wherein the support channel 17 further includes a series of securement brackets 21 orthogonally secured to the rear surface 23 of the support channel 17 and formed with through-extending aperatures for receiving "U" shaped clamps 22 to secure the support channel 17 to the support channel "S".

A support rod 24 is rotatably mounted inteiorly of the support channel 17 and extends essentially the entire length thereof terminating in a lowermost hexagonal configured extension **24*a* for accepting a conventional socket or the like thereabout to effect rotation of the support rod 24, to be discussed in more detail. A series of support bearings comprising a lowermost support bearing 25, an intermediate support bearing 26, and a top support bearing 27 rotatably and fixedly position the support rod 24 relative to the interior confines of the support channel 17. The support rod 24 is threaded between the intermediate and top support bearings 26 and 27 in a threaded section 28. A support cylinder 29 has fixedly and securedly positioned at upper and lowermost portions thereof a lower internally threaded nut 30 and an upper internally threaded nut 31 to receive the threaded section 28 whereupon rotation of the support rod 24 and associated threaded section 28 reciprocatably positions the support cylinder 29 along the length of threaded section 28. The support cylinder 29 has fixedly secured at diametrically opposed sides thereof the respective first and second horizontal support arms 13 and 14, as illustrated in FIGS. 2, 3, and 4. It may therefore be appreciated that as the support cylinder is vertically positionable along the threaded section, the support arms 13 and 14 with the associated backboard 12 and frame and net organization 11** are also reciprocated therewith.

Attention to FIG. 5 illustrates a modification including an elongate enclosing first and second respective resilient sealing flaps 32 and 33 enclosing the associated first and second elongate slots 19 and 20 formed within a further support channel 117. The sealing flaps 32 and 33 are formed with a central slit to receive the associated support arms 13 and 14 respectively therethrough to prevent intrusion of airborne contaminant from entering the bearing and associated mechanism of the adjustment mechanism of the apparatus.

As to the manner of usage and operation of the instant invention, therefore, the same should be apparent from the above description and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An adjustable basketball backboard apparatus for securement to a support standard for varying the height of the apparatus relative to the standard, the apparatus comprising, a basketball net member orthogonally secured to a forward face of a vertically oriented backboard, and a first and second support arm secured their forward ends to a rearward face of the backboard and extending rearwardly of the backboard with rearward ends of the support arms extending interiorly of a support housing, said support housing including a rotatably mounted support rod coextensive with said support housing including a lowermost torguing means to effect rotation of the support rod, and a support means to securedly receive the rearward ends of the support arms and vertically adjustable relative to the support rod upon rotation of the support rod relative to the support means by application of force to the torguing means.

2. An adjustable basketball backboard apparatus as set forth in claim 1 wherein the support housing includes an elongate channel member, said channel member formed with a plurality of elongate slots comprising a first and second slot for receiving a respective first and second support arm at its respective rearward end.

3. An adjustable basketball backboard apparatus as set forth in claim 2 wherein said support rod is positioned medially of the first and second slots and wherein said support rod is fixedly positioned with said housing by a first, second, and third bearing.

4. An adjustable basketball backboard apparatus as set forth in claim 3 wherein said support rod is threaded between the second and third bearing wherein said second bearing is mounted intermediately of the support housing and wherein said third bearing is mounted at an uppermost portion of the support housing.

5. An adjustable basketball backboard apparatus as set forth in claim 4 wherein said support means comprises a cylindrical member with the first and second support arms fixedly secued to said cylindrical member at diametrically opposed sides of the cylindrical member, and said cylindrical member includes an upper and lower internally threaded nut member, and each nut member is threadedly mounted to the threaded portion of the support rod.

6. An adjustable basketball backboard apparatus as set forth in claim 5 wherein said support housing is formed with a concave arcuate rear face for securement to a cylindrical support standard.

7. An adjustable basketball backboard apparatus as set forth in claim 6 wherein a plurality of securement brackets are formed adjacent the rearward face of the support housing and extend outwardly thereof, and further including a plurality of "U" shaped clamps for securement about said support standard and received within through-extending apertures formed in the securement brackets.

8. An adjustable basketball backboard apparatus as set forth in claim 7 further including a first and second resilient sealing flap positioned overlying each first and second elongate slot wherein each resilient flap is formed with a central slit for sealingly receiving the respective first and second support arm therethrough to seal the interior of the support housing against intrusion from contaminants.

9. An adjustable basketball backboard apparatus as set forth in claim 8 wherein a first and second horizontal strut is secured at one end to the respetive first and second support arms and at other ends to a rearward face of the backboard to triangulate the support arms, support struts, and backboard enhancing the structural integrity of the appartus.

10. An adjustable basketball backboard apparatus as set forth in claim 9 wherein the torquing means comprises an hexogonally configured extension axially aligned with said support rod for receiving a force applying tool thereto.

* * * * *